United States Patent [19]

Bruggi

[11] Patent Number: 4,644,602

[45] Date of Patent: Feb. 24, 1987

[54] MACHINE FOR AUTOMATICALLY CARDING SOLES OF FOOTWEAR

[76] Inventor: Mario Bruggi, Corso Torino, 114-Vigevano (Pavia), Italy

[21] Appl. No.: 714,378

[22] Filed: Mar. 21, 1985

[30] Foreign Application Priority Data

May 4, 1984 [IT] Italy ..... 20803 A/84

[51] Int. Cl.[4] ..... A43D 117/00

[52] U.S. Cl. ..... 12/1 A; 12/77

[58] Field of Search ..... 12/1 A, 70, 18.5, 17.2, 12/33.6

[56] References Cited

U.S. PATENT DOCUMENTS

| | | | |
|---|---|---|---|
| 1,286,473 | 12/1918 | Winkley | 12/1 A |
| 3,290,708 | 12/1966 | Spencer | 12/1 A |
| 3,631,553 | 1/1972 | Holland | 12/1 A |
| 4,555,823 | 12/1985 | Pedretti | 12/77 |

FOREIGN PATENT DOCUMENTS

| | | | |
|---|---|---|---|
| 2848815 | 5/1979 | Fed. Rep. of Germany | 12/1 A |
| 1401001 | 7/1975 | United Kingdom | 12/1 A |
| 1438577 | 6/1976 | United Kingdom | 12/1 A |

*Primary Examiner*—Henry S. Jaudon
*Assistant Examiner*—Steven N. Meyers
*Attorney, Agent, or Firm*—Bucknam and Archer

[57] ABSTRACT

The machine carries out the operations of roughening, reducing, straightening and the like on soles for footwear. The sole is automatically transferred under a processing unit by a carrier moving stepwise and provided with a plurality of driving blocks. A fixed stroke actuator comprises a pegged disc connected by mechanical transmission to the carrier. A bolt locks the carrier and arrests the carrier in the forward motion. During the return course of the actuator, the driving blocks withdraw from the sole.

8 Claims, 6 Drawing Figures

MACHINE FOR AUTOMATICALLY CARDING SOLES OF FOOTWEAR

BACKGROUND OF THE INVENTION

The present invention relates to machines for attaching heels to the soles of shoes.

DESCRIPTION OF THE RELATED ART

It is known that in order to permit the attachment of heels, glued inserts and the like to soles of shoes, the soles are treated so as to produce a roughening and/or a reduction of the sole in some portions. These operations are usually carried out manually or on a semiautomated basis but there is a need of a machine which could carry out these operations automatically. For this purpose, it is necessary to place the sole under the tool which carries out the processing guided by a template, with high precision, removing the sole from a stacker, transferring it under the tool and feeding it subsequently into the various processing stages, with the possibility that necessary adjustments according to various sole dimensions are carried out.

SUMMARY OF THE INVENTION

An object of the present invention is to provide a machine which permits to carry out these operations.

The machine according to the present invention permits to roughen certain portions of the soles for footwear. The machine comprises at least one carder which carries a tool capable of lateral motion guided by a template, under which the sole is placed with high precision by a carrier having several driving blocks acting on the soles. The carrier is actuated by an actuator having fixed stroke, acting, by means of a lever, on a pegged disc. In addition, the machine comprises a bolt for locking in position and means for controlling the arrest position of the carrier. This fixed-stroke actuator is equipped with a flexible lever capable of acting in the extension of the actuator, on one of the four pegs carried by the disc, thus causing a rotatory movement of the disc in the sense that it produces, by means of transmission means associated with the disc itself, the advance of the carrier through a path carrying the sole under the carder.

The fixed-stroke actuator is equipped with a cam element located upstream of the lever, capable of acting during the return run of the actuator upon the peg pushed by the lever, causing a rotation of the disc through an angle such as to remove said driving block from the sole with which it is in contact for a limited distance, sufficient to permit processing in all the portions of the sole. This disc is equipped with a crown gear connected by several chain gears to a control wheel having an orifice capable of receiving a blunt pin bolt operated by an actuator. The insertion of the pin into the opening causes with the required precision the arrest position of the carrier.

The control wheel may be coupled to the pulling wheels of the carrier through a transmission joint, the coupling position of which may be varied according to the desired arrest position. For the purpose of carrying out operations on more than one zone of the same sole, several carders or other units may be placed in sequence, at predetermined distances, fed by a single carrier which, by its forward motion, stepwise, will carry the soles to one after another of the processing zones.

DESCRIPTION OF THE DRAWINGS

Further details will be evident from the following description of an embodiment of the invention with reference to the accompanying drawings of which.

Figure 1:
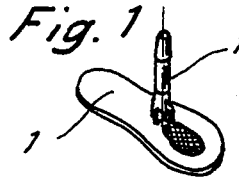
FIG. 1 is a sole with a processing tool.
Figure 2:
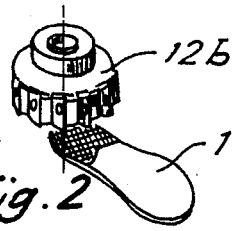
FIG. 2 is a sole with a different processing tool.
Figure 3:
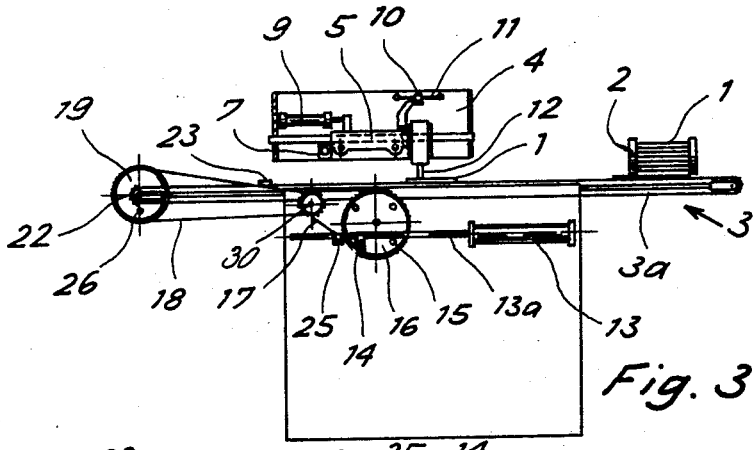
FIG. 3 is a schematic side view of the machine.
Figure 4:
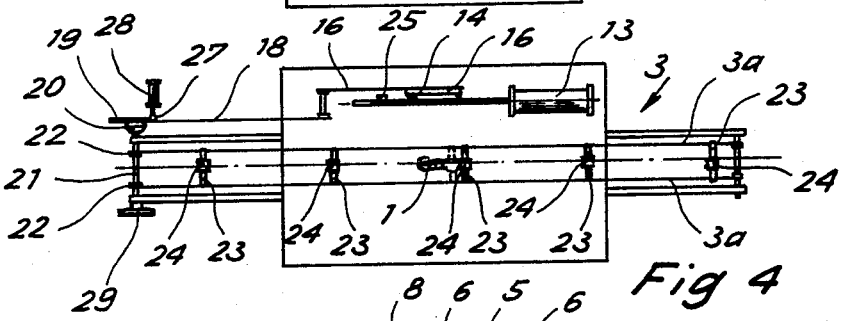
FIG. 4 is a plan cross-sectional view of the machine.
Figure 5:
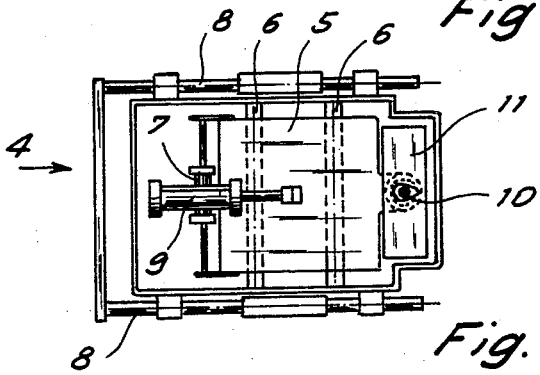
FIG. 5 is a detail of the carder.

Operations in order to roughen or reduce limited portions of a sole may be required in order to attach inserts, for example gummed ones, as shown in FIG. 1, or to facilitate the attachment of the heels as shown in FIG. 2. The automatic machine permits to carry out these operations and as shown in FIG. 3, removes the sole (1) from a stacker (2) and moves it with the help of chain carrier (3) into processing position under the carder (4). The chain carrier 3 has chains 3*a* connected to each other at regular distances by crosspieces 23 which carry shaped blocks 24, the latter having the shape of the rear end of a sole. Under the chains 3*a* a flat surface is provided, along which the soles 1 slide pushed along their rear surface by the shaped blocks 24. This unit better illustrated in FIG. 5 comprises movable carriage (5), movable along guides (6) by means of a cylinder (7) and along guides (8) by means of cylinder (9). The carriage (5) carries the copying roller (10) which, by means of the template (11), determines the shape of the area of the sole worked by the tool (12). The regular transfer of the soles (1) into the position of operation is achieved by a fixed-stroke actuator which may consist of the cylinder (13) acting, with lever (14), on one of the four pegs (15) equidistant from the center of a cog wheel (16). Wheel (16), by means of the chains (17,18) and a crown gear (30) rotates the wheel (19) which is connected by means of a joint (20), to shaft (21), the latter carrying the cog wheels (22) around which are wound the chains (3*a*) of the carrier (3) as shown in FIG. 4. The chains (3*a*) carry a plurality of regularly spaced crosspieces (23), on which are located the shaped blocks (24) capable to hold the rear end of the sole, pushing it for the forward stroke of the carrier (3). On the shaft (13*a*) of the cylinder (13) there is also present a cam element (25) capable of acting on peg (15) during the return movement of the shaft of cylinder (13), causing a limited rotation of the wheel (16) in the direction opposite to the rotation due to the lever (14) in order to remove block (24) from sole (1) which rests on the flat surface on which it is made to slide permitting it to be worked in the heel area.

Figure 6:
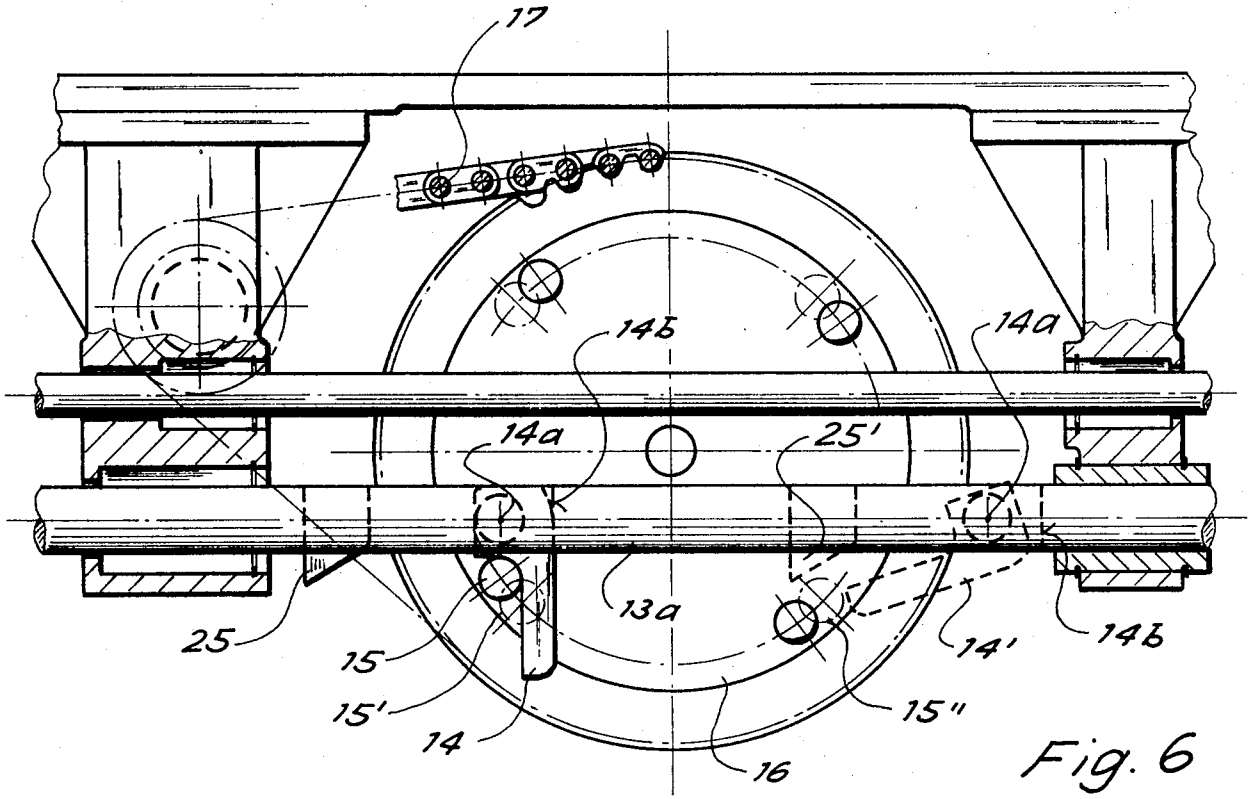
FIG. 6 is a detail of the feeding device.

On the wheel (19) there is an orifice (26), capable of receiving a blunted pivot (27) which is set in motion by the actuator (28). This device permits an accurate positioning of the carrier (3) independent from the inevitable slack in the chain transmission (17,18) because the tapered end of the pivot 27, entering the orifice, causes the wheel 19 to turn further for a small amount, as long as it reaches the correct position when the pivot 27 is completely introduced in the orifice. The joint (20), which may be released by means of the handle (29), moreover permits to adapt the arrest position of the shaped block (24) to the dimensions of the sole being worked, thereby permitting it to be worked in the desired position, with high accuracy. The work cycle of the machine provides, therefore, as is also shown by FIG. 6, the total movement of the shaft (13*a*) of cylinder (13) in such a way as to drive peg (15), with which lever (14) has come in contact, into the position illustrated by solid line in FIG. 6. The lever (14) is hinged at 14*a* to the shaft (13*a*) and its counterclockwise rotation is blocked by a bearing surface (14*b*) shown in broken lines in FIG. 6. To this advancement corresponds a rotation of wheel (19) and the forward motion of the crosspiece (23) of the carrier (3) which pushes the sole (1) through a course that carries the sole (1) under the carding unit (4). The cylinder (28) is then actuated which, by inserting the blunted pivot (27) into the orifice (26) of the wheel (19) causes the exact arrest position of the carrier, placing the sole (1) into the required position. The pivot (27) is then removed and the shaft (13*a*) of the cylinder (13) is allowed to complete its return course, during which the cam (25), acting on the peg (15), causes a backward rotation of the wheel (16), pushing the peg (15) into position 15′ of FIG. 6 and removing block (24) from the sole which now may be worked while at the same time, it is held in place by a pressing unit (not shown). As the return phase of the shaft (13*a*) continues, the lever (14), being hinged to it, overtakes the peg (15″) and is now ready for the next run in forward direction as is shown by solid line in FIG. 6.

As shown in FIG. 1, the operations of the toe and the heel portions of the sole (1) require different tools, respectively 12*a* and 12*b*. For the purpose of carrying out these operations on the same sole, it may be convenient to install from the beginning two or more carding units (4) in sequence, fed by the same carrier (3), extended to the required length so that the sole may be subjected to one processing phase at the time the carrier first moves forward and to the next phase with the further forward motion of the carrier.

In case it is desired to carry out other processing operations on the sole, such as the imprinting of a trademark, of a number or the like, or other operations, the carrier (3) may be further extended in order to furnish all the required processing stations.

Several variations may be introduced in the illustrated machine without departing from the scope of this invention.

What is claimed is:

1. A machine for carding of a sole of footwear, which comprises at least one carding unit carrying a sliding tool, a template for guiding the sliding tool, a chain carrier for placing the sole under said template, said chain carrier having a plurality of driving blocks acting on said sole and a control wheel, a fixed-stroke actuator for the said chain carrier, a pin (27) for arresting said chain carrier engageable with said control wheel and means for regulating the arrest position of said chain carrier.

2. The machine according to claim 1 wherein said fixed stroke actuator acts on a disc, said disc having four pegs equidistant from the center of the disc, said actuator having a movable shaft, a flexible lever being located on said shaft, said lever acting in the extension of said actuator, on one of said pegs, causing a rotation of said disc in a sense that produces the forward motion of said chain carrier on a course that pushes said sole under the carding unit.

3. The machine according to claim 2 wherein transmission means are associated with said disc for producing the forward motion of said carrier.

4. The machine according to claim 2 wherein said fixed stroke actuator has a cam element placed upstream of said lever, said cam element being capable of acting, during the return stroke of said actuator, on the peg pushed by said lever, causing a rotation of said disc in the direction opposite to the forward motion, through an angle such as to remove the driving block with which the sole is in contact from the sole by a short distance, sufficient to allow for processing in all areas of said sole.

5. The machine according to claim 3 wherein said chain carrier has cog wheels, said disc has a crown gear connected, through chain gears, to a control wheel adapted to be coupled to said cog wheels, said control wheel having an orifice, a cylinder actuating a blunt pin which enters said orifice, whereby said pin is inserted into said orifice determining the stop position of the chain carrier.

6. The machine according to claim 5 wherein said control wheel couples with said pulling wheels of the carrier by a transmission joint of variable engagement position.

7. A machine for carrying out processing operations of roughening, reducing the thickness, straightening soles of footwear by means of a tool (12) which comprises means for stacking the soles, means (3) for removing one sole at a time and transporting said sole under a carding unit (4), said means for transporting the sole comprising a fixed stroke actuator, a toothed wheel (16) having four pegs equidistant from the center of the toothed wheel (15), lever (14) for engaging with one of said pegs, a carrier (3) with chains (3*a*) for carrying one sole at a time, said actuator actuating said carrier, said carding unit comprising a movable carriage (5), a tool (12) for carrying out the processing operation on the sole, said carriage having a coupling roller (10) and a template (11) for determining the portion of the sole to be worked on, and means for arresting the forward motion of said carrier.

8. The machine according to claim 1 which has a plurality of carding units arranged in series at predetermined distances, and said carrier advances stepwise to bring each sole into the successive processing positions.

* * * * *